US007030855B2

(12) United States Patent
Metcalf

(10) Patent No.: US 7,030,855 B2
(45) Date of Patent: Apr. 18, 2006

(54) VIDEO-IMAGING APPAREL WITH USER-CONTROL SYSTEM

(76) Inventor: Darrell J. Metcalf, 905 N. Oak Ave., Fillmore, CA (US) 93015

( * ) Notice: Subject to any disclaimer, the term of this patent is extended or adjusted under 35 U.S.C. 154(b) by 59 days.

(21) Appl. No.: 09/929,615

(22) Filed: Aug. 13, 2001

(65) Prior Publication Data

US 2002/0167483 A1 Nov. 14, 2002

Related U.S. Application Data

(60) Provisional application No. 60/225,612, filed on Aug. 15, 2000.

(51) Int. Cl.
*G09G 5/00* (2006.01)

(52) U.S. Cl. ..... 345/108; 345/85; 345/156; 362/103

(58) Field of Classification Search ..... 345/107, 345/156, 84–85, 108; 359/296; 428/323; 362/103, 108; 40/586, 550, 583
See application file for complete search history.

(56) References Cited

U.S. PATENT DOCUMENTS 4,602,191 A * 7/1986 Davila ..... 315/76
5,455,906 A * 10/1995 Usuda ..... 395/162
5,575,554 A * 11/1996 Guritz ..... 362/103
5,774,338 A * 6/1998 Wessling, III ..... 361/730
5,912,653 A * 6/1999 Fitch ..... 345/87
5,986,629 A * 11/1999 Smith et al. ..... 345/84
6,252,564 B1 * 6/2001 Albert et al. ..... 345/107
6,314,669 B1 * 11/2001 Tucker ..... 40/448
6,445,489 B1 * 9/2002 Jacobson et al. ..... 345/107
6,462,859 B1 * 10/2002 Bastiaens et al. ..... 345/107
6,679,615 B1 * 1/2004 Spearing ..... 362/103

* cited by examiner

*Primary Examiner*—Lun-yi Lao

(57) ABSTRACT

A wearable pixelated apparel video-displaying system is disclosed comprising at least one flexible lightweight pixelated material having a contiguous imaging surface comprised of a multitude of pixels capable of displaying typical video rate, video image content which is contiguous in appearance and which covers up to all of the surface. The apparatus is equipped to playback, control and display imagery according to the size and the shape of one or more pixelated material segments making up the video-displaying apparel. The apparatus has an input/output interface a digital media content playback device, a user interface means for a user to communicate with the apparatus and to control the playback of at least one source of video content. In one embodiment the pixelated-image displaying apparel is contiguously formed into a single garment. In a second embodiment a plurality of apparel segments are adjoined to one another by attachment, and are electronically coupled together.

27 Claims, 4 Drawing Sheets

VIDEO-IMAGING APPAREL WITH USER-CONTROL SYSTEM

CROSS-REFERENCE TO RELATED APPLICATION

This is a non-provisional patent application, which is related to provisional patent application 60/225,612 filed Aug. 15, 2000.

FIELD OF THE INVENTION

The present invention generally relates to a method of making apparel that has a contiguous video-imaging surface made out of one or more highly flexible pixelated materials—including the types of material being developed for making 'ePaper' or 'eNewspaper'—such that the apparel will be lightweight, comfortable and thermally tolerable, when worn by individuals. More particularly, the invention pertains to methods whereby such apparel can be contiguously formed, or formed having apparel edges and/or apparel pattern-segments, that can be physically adjoined to one another or to other apparel components, to provide a contiguous video-imaging surface, and have electronic coupling to video control and display apparatus to receive digitally formatted media content that are sized and shaped for display on: one or more receiving apparel segments; or, combination of apparel segments; or, contiguously-formed apparel.

BACKGROUND OF THE INVENTION

For a number of years, pixelated display technology has been under development and many advances have been made in reducing the cost, the rigidity, the heat and the power consumption of such displays. In several cases, LCD display technology has advanced to the point where many portable computers now offer pixelated screens having a brightness, color and contrast that rival the display imaging capabilities of competing cathode ray tubes.

R&D efforts are currently leading to a new type of lightweight, durable and highly flexible material that can be used to produce what is being referred to as an 'electronic reusable paper' which will be provided by 3M Corporation within 1–2 years. The terms 'ePaper' and 'eNewspaper' are also gaining acceptance. The present invention utilizes any one or more highly flexible pixelated material of a type like that which has been, or is being, developed for 'ePaper' and 'eNewspaper'—including such materials that are designed for color and video imaging—to form, or fabricate, such highly flexible material into wearable goods having a substantially contiguous imaging surface area. (For the sake of brevity the term 'ePaper' will be used to refer to this technology as it pertains to the present invention). Such ePaper innovations are expected to create 'digital newspapers' and 'digital magazines' printed on pages as flexible as newsprint and having an imaging capacity that will rival computer screens and the content of the Internet. IBM's Research Triangle Park has debuted the 'eNewspaper'. Scientists at Xerox PARC, in partnership with 3M, have produced an electronic-paper prototype with the contrast and resolution of a printed page. Other efforts are under way by E Ink Inc., and by IBM, to develop a paperlike screen that will display information dynamically (ones that can be erased, rewritten and updated in real-time). PARC and 3M's approach is for black & white display material and uses an electrostatic charge to turn on or off the polarity of a multiplicity of tiny beads each having a black side and a white side (e.g. 200,000 per page). The beads flip and remain turned according to the polarity of electronic charge they receive—thus making a highly readable (and changeable) image. E Ink is developing flexible thin film transistor (TFT) pixelated display material in partnership with Lucent Technologies' Bell Labs.

Although effective LCD screens exist, they have nonetheless remained inappropriate for consideration in the fabrication of apparel for several reasons. For example, all laptop screens depend on a thin-film transistor (TFT), the technology behind every LCD display that switches pixels on and off. Traditionally TFTs are made by spreading amorphous silicon (a semiconductor) on a substrate of glass. However, the silicon on glass technology does not make for a very flexible material. Plastic, which is flexible, would be melted by the 680-degree-Fahrenheit temperatures needed to process the amorphous silicon. Thus, a lack of LCD flexibility sufficient to accommodate the curves associated with apparel, and such high LCD temperatures, as well as its weight, bulk and cost, are some of the significant factors which have prohibited the inclusion of LCDs into the design and fabrication of apparel, garments and other wearable goods.

Recently however, a great deal of R&D is occurring to make cool, highly flexible and lightweight pixelated materials that can be electronically controlled at much lower temperatures (which also means lower power consumption). For example, Lucent has announced a material called 'alpha-6T' that conducts electricity as efficiently as amorphous silicon, but can be processed at room temperature. Lucent plans to have a working prototype of its flexible TFT by Q4 2000. IBM is combining a flexible TFT similar to Lucent's technology with a 'digital paper' made of organic LED ('oLED'). The technology is composed of organic polymer and fluorescent dye layers less than 0.2 microns thick, sandwiched between two electrodes (the top one is transparent). A steady current from the electrodes excites the polymer molecules, causing them to emit a pure, flicker-free light. With a viewing angle of 160 degrees, oLEDs are as readable as paper. The oLED approach has several advantages: the organic materials can be deposited easily on a surface of any size; oLED screens use about half the power of an equivalent active-matrix LCD; and, each pixel is composed of three 'subpixels' that deliver true RGB color at better than 200-dpi resolution. Kodak, which pioneered the oLED technology also plans to release 'foldable-as-paper' oLED material. IBM is also developing another technology out of their Thomas J. Watson Research Lab where researchers are combining polymers with inorganic materials, purifying the mixture, and in a sterile environment, depositing it onto a plastic substrate. The result is an organic/inorganic compound that can be applied to plastic in a liquid form at room temperature. The liquid evaporates and then the inorganic and organic materials self-assemble, alternating layers, to form perovskite—a crystal with the properties of a semiconductor. The result is TFTs that are easy to manufacture in any size and for less than one-tenth the production cost of a silicon-based TFT.

As numerous companies begin to provide pixelated materials that are as flexible or as 'foldable' as paper, and offer the immersive quality of constantly streaming information (or other dynamic imagery such as that seen on the Internet or on television), the prospect of employing such materials—that will also be lightweight and thermally comfortable when worn as visually dynamic apparel—can practicably be achieved. It is the purpose of the present invention to provide methods of making lightweight and wearable apparel out of thermally comfortable, highly flexible pixelated-material, and in so doing, to provide visually-dynamic clothing and goods that can be erased, rewritten and 'upgraded' in either in real-time or by pre-programming their appearance ahead of time, and preferably include the capability to image digital video onto the apparel and/or onto shapes typical of apparel segments and/or apparel components. Such visually-dynamic apparel will not only offer the ability to image virtually any fabric or textile appearance, but virtually any appearance imaginable whether static in appearance, or periodically changing, or constantly changing e.g. video playback of any film, animated, photographed, video, computer-generated (or otherwise digitized) media content. Such versatility of apparel appearance is ideal for entertainment costumes and stage productions, and can also be employed as an advertising, or promotional, or cross-promotional exhibiting means.

It is also a purpose of the present invention to provide practical methods for adjoining such highly flexible pixelated material to itself, or to other like material, to form wearable video-imaging apparel. Another purpose of the present invention is to overcome the shortcomings and deficiencies in previous attempts to create apparel out of pixelated material having too much rigidity, or too difficult to dependably join to itself or to other pieces of like material in an aesthetic manner, or too heavy, or too bulky, or too hot to be considered thermally-intolerable or thermally-uncomfortable, or too energy-consuming, or not economically viable for production of a variety of shapes (such as the shapes of apparel pattern segments that make up common wearable attire and goods). By contrast, the present invention discloses practicable methods for adjoining any one or more of a variety of flexible pixelated material shapes and/or apparel pattern segments and electronically couples such shapes and/or segments to receive displayable content for pixelated materials, and overcomes the limitations described above.

PRIOR ART

Search for prior art references has not revealed apparel having a substantially contiguous video-imaging surface over the entire surface area of one or more type of apparel, or apparel that are made of material that can be adjoined in imageable segments that will collectively appear contiguous when video imagery is displayed thereon. The search has also not revealed apparatus for controlling and formatting video imagery on such surfaces, or video-imaging apparel comprised of lightweight highly flexible pixelated material(s) of a type similar to that which has been, or is being, developed for ePaper.

By way of reference, a search of the related field shows a different semi-rigid LCD approach wherein the inventor (Fitch of U.S. Pat. No. 5,912,653)—instead of making apparel out of a highly flexible video-displaying material—first begins with an existing "garment" such as a jacket, he then cuts one or more apertures in the garment, through each of which a "flat panel liquid crystal display" "protrudes from" . . . "aperture 14" and is "disposed on the surface of said garment". A plurality of such embedded LCDs is not illustrated or described in the Fitch invention, however one might surmise that Fitch's method, of releasably attaching a plurality of flat panel LCDs to a garment, could be accomplished by the creation of a mosaic matrix of side-by-side rectangular screens (Fitch does not describe non-rectangular LCD screen shapes). It is likely that such an approach would be very bulky in appearance and therefore probably not have a pleasing aesthetic. As previously mentioned, LCDs are usually produced on a glass substrate to tolerate 600+ degree Fahrenheit temperatures, and the glass does not provide a material that would be considered to have a flexible property anything like that of a material suitable for apparel. Fitch also does not show, describe or claim how multi-LCDs can be either aligned, or adjoined, to one another in order to create a substantially contiguous video imaging surface, therefore it is presumed that when a plurality of LCDs are used they would have to have gaps to accommodate body movement therebetween and the edges thereof—if not encased in a protective non-imaging rim—would be subject to damage. Thus, the Fitch system has numerous deficiencies attributable to the bulk, weight, power usage, heat, limited flexibility, non-contiguous imaging surface, aesthetic considerations, and durability, when embedding a plurality of LCDs into existing garments.

In a single paragraph, Fitch briefly alludes to a garment having a plurality of apertures, through each of which, a tri-color diode protrudes (the tri-color diode being comprised of two colored diodes, per FIG. 7) and that the diodes are "in different apertures throughout the jacket". However, no arrangement of the multiple tri-color diode system is illustrated (or claimed), and one is left to surmise from a vague structural description what Fitch's intent is: how the diodes are consolidated, whether they are in close proximity to one another or not (in a durable arrangement?), how the garment's diode-filled apertured material is actually made, or otherwise provided, and perhaps most importantly, how such an array of diodes—particularly if arranged in any non-rectangular format—receives correctly-formatted video signals of the various types mentioned in the invention. Fitch's tri-diode concept is also not addressed in the system's schematic (FIG. 6), or in any descriptions pertaining to: the invention's circuitry; or, pertaining to the formatting and/or reception of the various video signals Fitch details. In addition to the structural questions that remain, there is also no operational description of the tri-diode concept in the context of the Fitch system.

Fitch's system requires starting with a garment and then modifying the garment to accommodate LCDs. This step is unnecessary and is eliminated by the present invention.

By contrast, the present invention, shows simply and clearly, how video-imaging apparel is comprised almost entirely of a lightweight material that is designed to be highly flexible, and durable enough to fabricate apparel therefrom, particularly apparel having a substantially contiguous video-imaging surface over much, or all, of the surface area of wearable goods—or made of material that can readily be adjoined in imageable segments such that combined segments will collectively provide a substantially contiguous video-imaging surface over the apparel. The present invention also provides video-imaging display apparatus including digital video formatting means, the latter of which, formats digital video content according to the size and shape of each video-imaging apparel, or of segments that are combined to make up such apparel, such that any one or more of a variety of video content sources can be rendered contiguously over the video-imaging display surfaces of such apparel.

SUMMARY OF THE INVENTION

In accordance with the present invention, a method is defined for forming or otherwise fabricating highly flexible pixelated material into video-imaging apparel having one or more substantially contiguous video-imaging surface. The fabrication method includes adjoining one or more highly flexible pixelated material to itself or to other pieces of like material, or to one or more other apparel component. The pixelated material is of a type similar to that which has been, or is being, developed for ePaper publications, and for receiving and displaying video signals, including any one or more of a variety of known storable and retrievable media-content suitable for imaging onto one or more pixelated display. The flexible pixelated material adjoining methods include any one or more in a variety of known adjoining methods suitable for adjoining such flexible pixelated material to itself, or to another like material, or to one or more other apparel component(s), including, but not limited to one or more: heat-sealed joints; sonic-welds; glued joints; adhesive joints; hook-and-loop fasteners; buttons; snaps; staples; rivets; zippers; hooks; tongue-in-groove fasteners; stitched seams; sewed seams; knotted seams, and the like. Heat-sealed, welded, adhesive, glued joints and the like are accomplished by employing any one or more of a variety of known joint methodologies including but not limited to: butt joints, miter joints, overlapping joints, tongue-and-groove joints, and the like.

Alternatively, some wearable goods can be made, formed or fabricated out of a contiguous pixelated material, for example, formed out of a highly flexible pixelated material that may also optionally be stretchable, for apparel such as skirts, headbands, belts, bracelets, shoes, sandals, and the like. Such wearables, can optionally include fastener means such as those mentioned above to facilitate their retention on, or removal from, the body.

Optionally, any of the video-imaging apparel can include an insulative liner made of a fabric or other comfortable material to add to the tactile and/or temperature comfort, wearability, modesty, and/or safety of the wearable goods.

The flexible pixelated material adjoining means can also include any one or more of a variety of known electronic coupling means suitable for establishing a communications link between one or more imaging apparatus and one or more highly flexible pixelated material. The imaging apparatus include any one or more of a variety of known apparatus suitable for outputting displayable content to one or more pixelated display. For example, the imaging apparatus can be comprised of at least one circuit (board or firmware, with an intelligent controller), a battery (or other power supply), at least one video input jack and circuit, a video input control and video formatting means, a USB port (or other type of I/O interface to receive, send and/or store digital media content), at least one video output circuit and jack, and an interface for communicating with and controlling one or more type of memory such as any one or more of the following: an interface slot for a matchbook-sized microdrive large enough to store hundreds of designs or video files; an interface to non-volatile memory; an interface to re-writeable memory; one or more hookup to visual-media content playback devices; or an IEEE 1394 interface to receive CD-ROM, DVD, storable and retrievable digitized visual-media content or digital video, video game I/O, and so forth. The system also includes video display formatting apparatus for formatting digital video according to the size and shape of: individual apparel-segments, or combined apparel-segments, or size and shape of contiguously-formed apparel, and an interface for pre-programming, or live switching among a selection of displayable-content that is so formatted.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

Figures 1A, 1B, 1C, 2A, 2B, 2C:
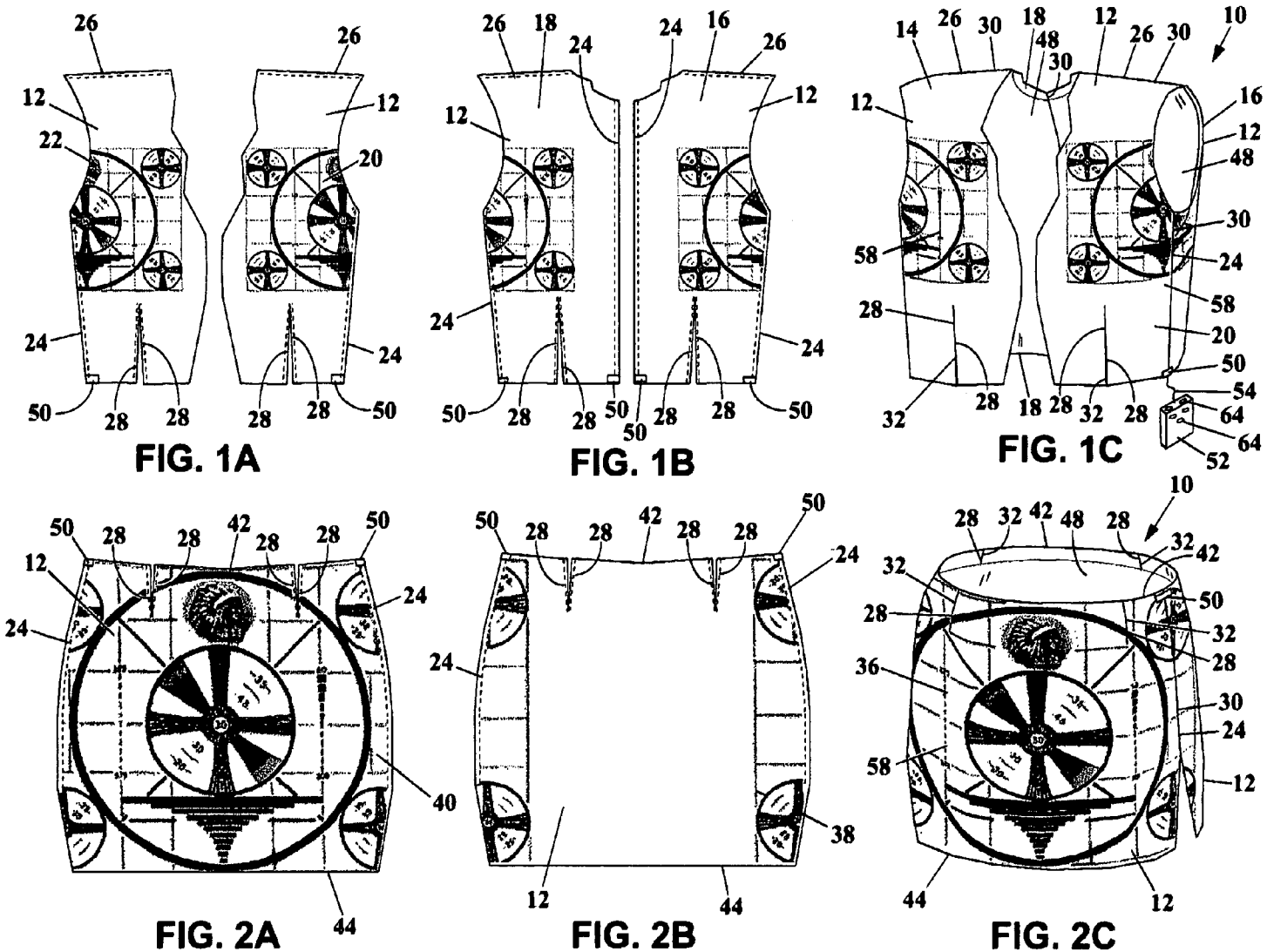
FIG. 1A is a front view of image-displaying apparel panels, specifically, a vest right-front segment and a vest left-front segment each having electronic coupling means, and adjoinable edge regions defined by dashed lines. Video display content is shown extending to an outer edge and adjacent to a seam on both front segments.
FIG. 1B is a front view of image-displaying apparel panels, specifically, a vest right-rear segment and a vest left-rear segment each having electronic coupling means, and adjoinable edge regions defined by dashed lines. Video display content is shown extending to an outer edge and adjacent to a seam on both rear segments.

FIG. 1C is a three-dimensional depiction of the combination of apparel segments represented in FIGS. 1A and 1B wherein apparel segments have been joined together at adjoining regions to form a vest having a substantially contiguous imageable surface, and are connected by a communication link with video display apparatus. Video display content is shown extending to an outer edge of both front segments and across a seam between a front and rear segment in a manner which is generally contiguous in appearance.

FIG. 2A is a front view of an image-displaying apparel panel, specifically, a skirt front segment having electronic coupling means, and adjoinable edge regions defined by dashed lines. Video display content is shown covering all of, and extending to all outer edges of, the skirt front segment.

FIG. 2B is a front view of image-displaying apparel panels, specifically, a skirt rear segment having electronic coupling means, and adjoinable edge regions defined by dashed lines. Video display content is shown covering some of, and extending to all outer edges of, the skirt rear segment.

FIG. 2C is a three-dimensional depiction of the combination of apparel segments represented in FIGS. 2A and 2B wherein apparel segments have been joined together at adjoining regions form a skirt having a substantially contiguous imageable surface. Video display content is shown extending to an outer edge of both the front and rear segments of the skirt and across a seam between the front and rear segments in a manner which is generally contiguous in appearance.

Figure 3:
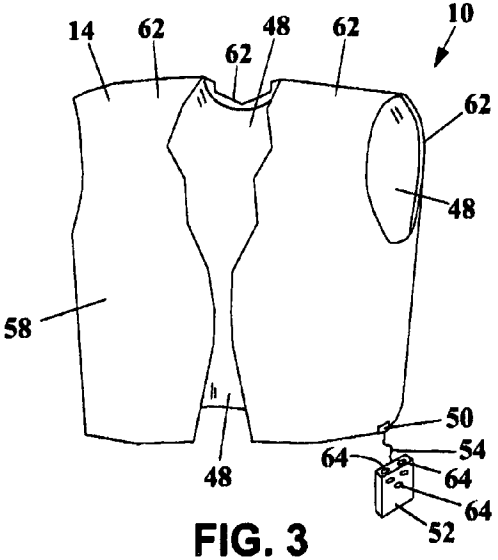
Figure 4:
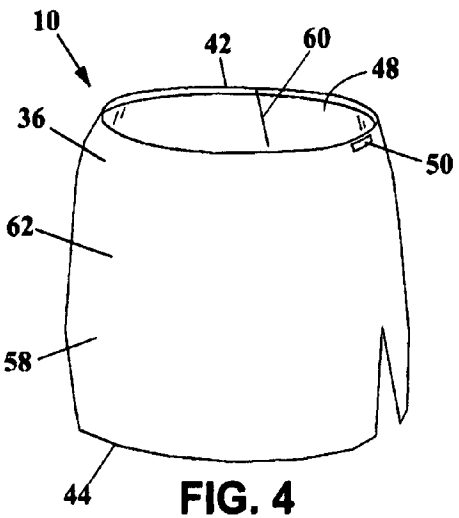

FIGS. 3 and 4 are views similar to FIGS. 1C and 2C respectively wherein the vest and skirt are each made of a contiguously-formed pixelated material.

Figure 5:
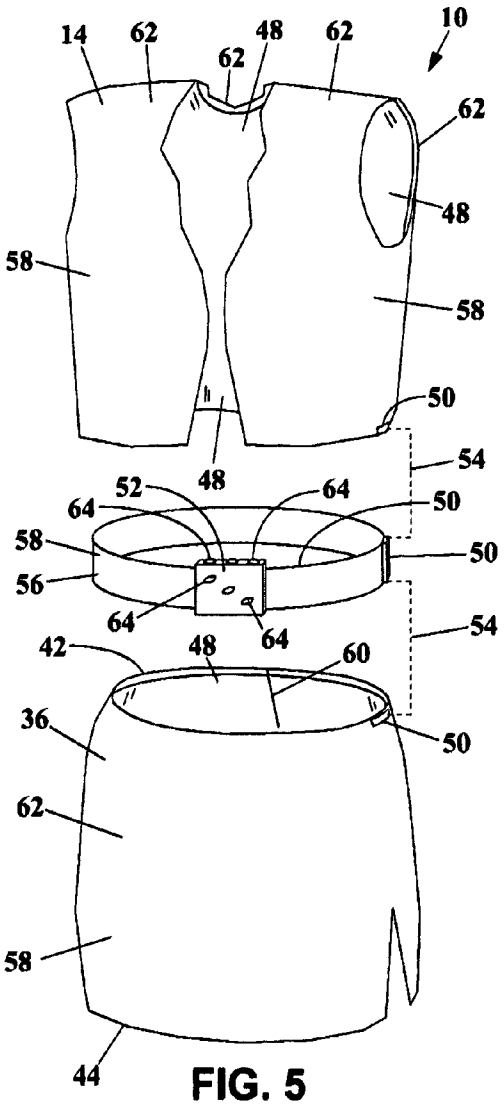

FIG. 5 is a view similar to the combination of FIGS. 3 and 4 wherein each of the contiguously-formed apparel shares a communication link to a belt incorporating video display apparatus, and wherein the belt material may optionally be comprised of highly flexible pixelated material.

Figure 6:
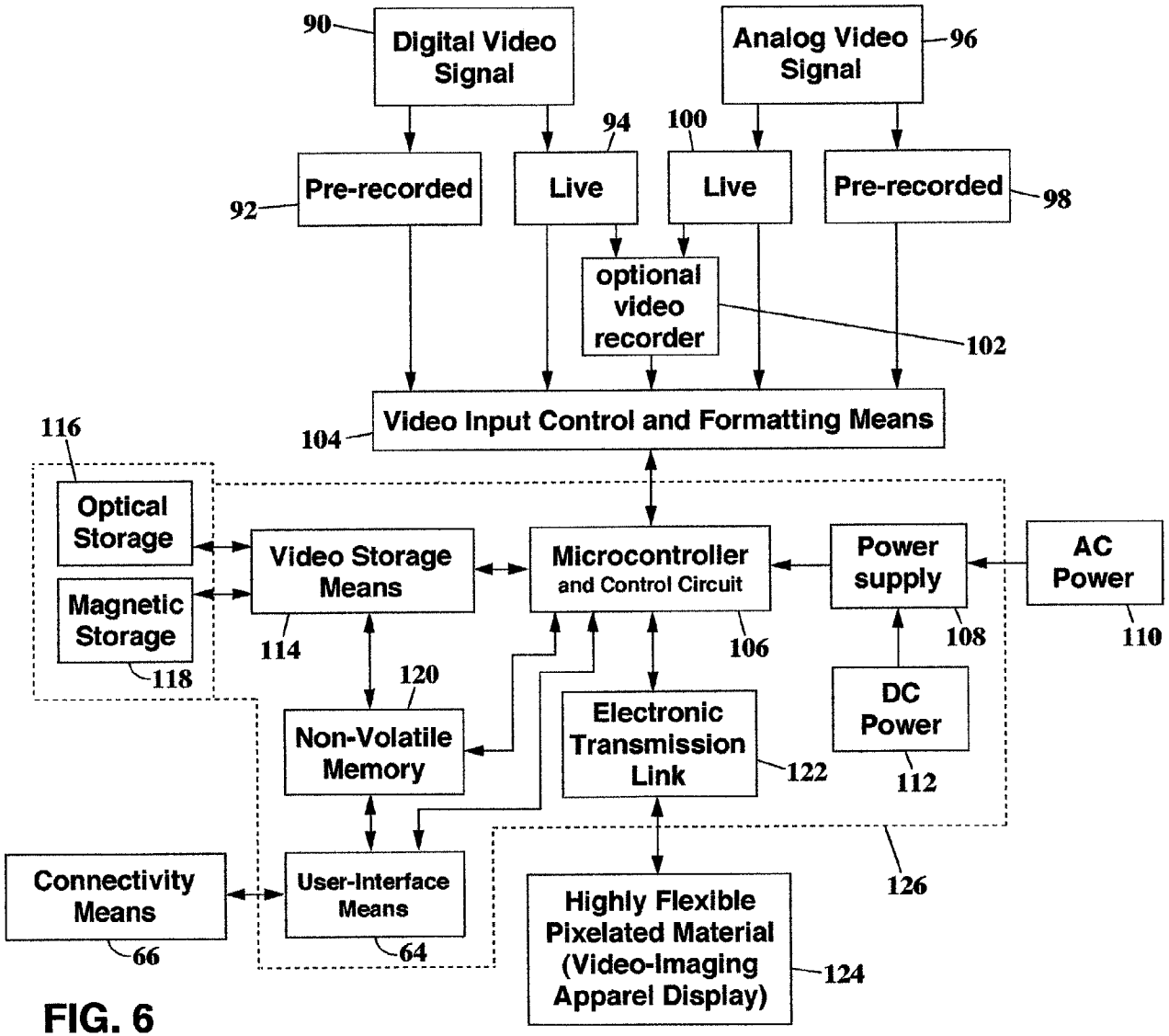

FIG. 6 is a schematic of the system's video-imaging apparatus.

Figure 7A:
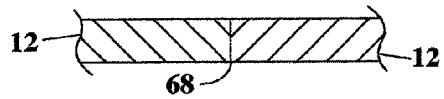
Figure 7B:
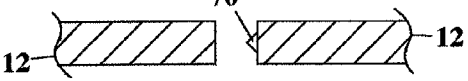
Figure 7C:
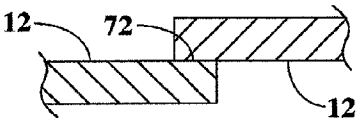
Figure 7D:
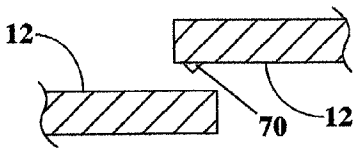
Figure 7E:
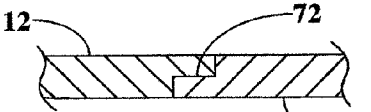
Figure 7F:
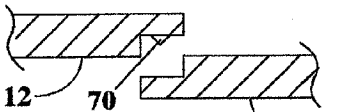
Figure 7G:
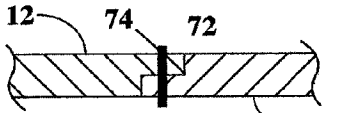
Figure 7H:
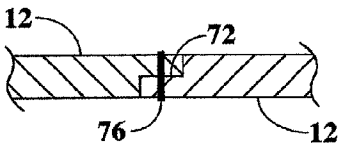
Figure 7I:
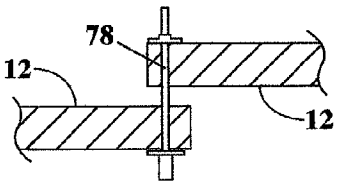
Figure 7J:
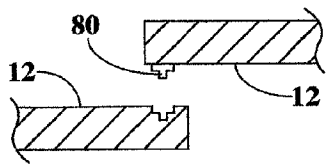
Figure 7K:
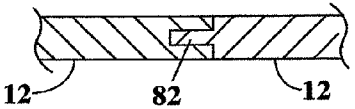
Figure 7L:
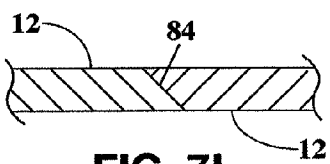
Figure 7M:
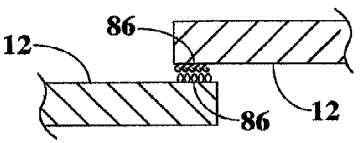
Figure 7N:
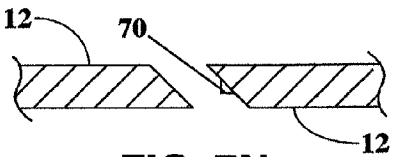
Figure 7O:
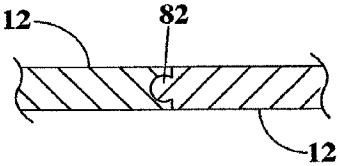

FIGS. 7A through 7O are cross-sectional illustrations of a variety of types of joints and adjoining means representing a selection group from which one or more methods can be used to join the edges of highly flexible pixelated materials together.

DESCRIPTION OF THE PREFERRED EMBODIMENTS

With reference to the drawings, a visually-dynamic pixelated-image displaying apparel is depicted comprising at least one flexible lightweight pixelated material having a contiguous imaging surface comprised of a multitude of pixels. The flexible pixelated material has electronic coupling means with at least one image-playback/image-control apparatus equipped to playback, control and display imagery according to the size and the shape of one or more pixelated material segment making up the displaying apparel. The image-playback/image-control apparatus is comprised of at least one control circuit, at least one intelligent controller, an electronic power source, at least one input/output interface means to receive and send digital media content, at least one digital media content playback means, a user interface means for a user to communicate with said apparatus and to control the playback of at least one source of digital media content, and intelligent controller software responsive to user input from said user interface means. The principal components used to implement the present invention are depicted by way of example in video-imaging apparel 10 seen in FIGS. 1C, 2C, 4, 4 and 5 wherein each is comprised of highly flexible pixelated material 12 of a type that is the same as, or similar to, that which has been, or is being, developed for ePaper, and which can display any one or more of a variety of video-media content (including color imagery). In FIGS. 1A through 1C and FIGS. 2A through 2C, the apparel is comprised of video-imaging panels made from highly flexible pixelated material 12 e.g. the vest left-front segment 20 and vest right-front segment 22 seen in FIG. 1A, and the vest left-rear segment 16 and vest right-rear segment 18 seen in FIG. 1B. In FIG. 1A, video display content is shown extending to an outer edge and adjacent to a seam on both front segments. In FIG. 1B, video display content is shown extending to an outer edge and adjacent to a seam on both rear segments. In FIG. 1C, video display content is shown extending to an outer edge of both front segments and across a seam between a front and rear segment in a manner which is generally contiguous in appearance. Each segment has at least one side adjoining edge 24, an upper adjoining edge 26, and at least one pleat adjoining edge 28. The segments are adjoined at adjoining edges as seen in FIG. 1C to form a plurality of seam 30 and a plurality of pleat 32 such that the composition of the apparel segments forms vest 14. It can be seen in FIG. 1C that when the vest is so formed, that a substantially contiguous video-imaging surface 58 is provided by the apparel. Optionally, the apparel seen in FIGS. 1C, 2C 3, 4 and 5, may have a lining material 48 to add to the comfort, or for modesty reasons to reduce the transparency, of the apparel.

Apparel segments are linked to one another by suitable electronic coupling means 50 and receive video signal from video display apparatus 52 via display transmission means 54 such that custom formatted video content (sized and shaped according to one or more video-receiving apparel segment) can be imaged thereon. For example, coupling means 50 can have a multi-conductor connection means—such as a multi-conductor wire or cable having a quick-release connector—to couple with other coupling means 50 (and connectors) located on adjacent apparel segments. The multi-conductor wire can be formed, or otherwise positioned, along a perimeter edge of an apparel segment. Alternatively, video display apparatus 52 and one or more electronic coupling means 50 can communicate via wireless communications links (e.g. by employing any one or more of a variety of known electronic apparatus suitable for the wireless transmission and/or reception of analog, or digital, video signal). Whether hard-wired or wirelessly activated, video display apparatus 52 can be equipped with a user-interface means 64 such as any one or more of a variety of known interfaces that are employed for playing, or recording, or navigating through a selection of, video content, including one or more live signals, or one or more types of pre-recorded signals. The interface can control video (and audio) content from live or other wireless sources, optical storage sources, magnetic storage sources, video game sources, and so forth.

In FIG. 2C a skirt 36 is seen fabricated from video-imaging apparel segments comprising skirt front segment 40 seen in FIG. 2A and skirt rear segment 38 in FIG. 2B, each segment having a skirt upper edge 42 and skirt lower edge 44. The apparel segments are adjoined at side adjoining edge(s) 24 as seen at seam 30 of FIG. 2C to form the substantially contiguous video-imaging surface 58. The pleat adjoining edge(s) 28 are adjoined at pleat(s) 32 of FIG. 2C. Adjacent to upper edge(s) 42 are electronic coupling means 50 which complete a video signal circuit when the apparel segments and coupling means are adjoined as seen if FIG. 2C. In FIG. 2A, video display content is shown covering all of, and extending to all outer edges of, the skirt front segment. In FIG. 2B, video display content is shown covering some of, and extending to all outer edges of, the skirt rear segment. In FIG. 2C, video display content is shown extending to an outer edge of both the front and rear segments of the skirt and across a seam between the front and rear segments, in a manner which is generally contiguous in appearance.

FIGS. 3, 4 and 5 are views similar to those of FIGS. 1C and 2C, however the substantially contiguous video-imaging surface 58 is instead part of video-imaging apparel that is contiguously formed of a seamless and pleatless highly flexible pixelated material. It is predicted from recent advances in pixelated material R&D that such contiguously formed materials of different sizes and shapes will be able to be produced. It is a purpose of the present invention to incorporate such advances in the technology as soon as they are available, to produce such contiguously-formed video-imaging apparel. Thus, in FIG. 3 a vest 14 is formed of flexible and contiguously-formed pixelated material 62 to provide apparel that has a substantially contiguous video-imaging surface 58. The contiguously-formed vest 14 has a communications link with video display apparatus 52 as previously described. Similarly, FIG. 4 shows a skirt 36 formed out of contiguously-formed pixelated material 62 having at least one optional auxiliary fastener 60 such as a zipper to assist in the retention, or removal, of the apparel from the body. Coupling means 50 of the skirt 36 has a communications link with video display apparatus 52 as previously described. The vest and skirt of FIG. 5 are identical to those of FIG. 3 and 4 respectively, however an additional and intermediary apparel item is included in the form of a video-imaging belt 56 which can optionally also incorporate video display apparatus 52 and user-interface means 64. Vest 14 and skirt 36 receive video signal via electronic coupling means 50 as previously described (i.e. either via connectors, or by wireless reception).

Although the apparel shown in the drawings depicts a vest, a skirt and a belt, it should be understood that these items have been selected as examples only, and that it is possible and desirable to make, fabricate, or form, a wide variety of video-imaging apparel out of the emerging lightweight and highly flexible pixelated materials previously mentioned and out of those yet-to-be-developed, or that may be produced specifically for apparel-making purposes.

FIG. 6 schematically depicts the apparel's video-imaging apparatus. A video input control and formatting means 104 receives any one or more of a variety of known video signals, such as those provided in commercial broadcasts, live broadcasts, or provided from connectable recordable or pre-recorded sources. For example, digital video signal 90 in the form of pre-recorded 92 (digital) format, or live 94 (digital) format is sent to one or more controllable optional video recorder 102, or to control and formatting means 104. Similarly, analog video signal 96 in the form of pre-recorded 92 (analog) format, or live 94 (analog) format is sent to one or more controllable optional video recorder 102, or to control and formatting means 104. A microcontroller and control circuit 106 is electronically powered by a power supply 108 receiving AC power 110 or DC power 112 e.g. one or lead-acid batteries, or batteries rechargeable from an AC power source. The microcontroller 106 has a electronic transmission link 122—such as the apparel coupling means 50 described above—which is coupled with one or more highly flexible pixelated material 124 (video-imaging apparel display, i.e. video-imaging segment, or contiguously-formed video-imaging apparel). When microcontroller 106 is so coupled to material 124, it is responsive to a code identification associated with each video-imaging segment, or each contiguously-formed video-imaging apparel. The apparel code may be entered by a user via user-interface means 64, or pre-programmed for a particular apparel (or apparel combination, or apparel segment), or the apparel coupling means 50 described above may additionally include a code such as the type that can be recorded in an EPROM, or other chip. In each case, the code is readable by and transmittable via microcontroller 106 to video input control and formatting means 104 which selects (switches) and provides correctly-formatted video content that fits the size and shape of each apparel segment, or apparel-whole. Control and formatting means 104 routes the formatted video content via transmission link 122 to its respective video-imaging apparel segment, or contiguously-formed video-imaging apparel (both being comprised of highly flexible pixelated material 124). Video playback can be automatic, or controlled in real-time by the user according to software routines made available in the control circuit of microcontroller 106. Alternatively, pre-programmed playback can be arranged ahead of time via the user-interface 64, and parameters relating thereto are storable in non-volatile memory 120. A connectivity means 66 can optionally be provided for facilitating such configurations from a computer (or personal digital assistant 'PDA', or other wireless device) via any one or more of a variety of known connectivity means such as input/output ('I/O') protocols, including but not limited to: serial I/O, parallel I/O, USB I/O, TCP/IP I/O, IEEE 1394 (or other optical) I/O, infrared I/O, 'Bluetooth' (or other radio frequency) I/O, PDA I/O, Internet or null modem connections, and the like. Memory 120 optionally provides the entering of user-access codes or passwords to allow user-verified access to the system.

Correctly-formatted digital video can be downloaded from video input control and formatting means 104 to video storage means 114, the latter of which, can also be coupled with one or more optical storage 116 device(s) and/or one or more magnetic storage 118 device(s). Thus, the system can playback correctly-formatted digital video either automatically or according to a user's real-time or storable preferences. Additionally, the system can be modularized to provide a smaller, more portable video playback apparatus 126 (indicated in dashed lines) that is also connectable to optical storage 116 and/or magnetic storage 118.

In another embodiment of the invention, the video input control and formatting means 104 receives video signal in the form of one or more video games, wherein the video-imaging apparel is also responsive to user-input via a user-interface means such as user-interface 64 or alternatively by a handheld wireless device that is capable of sending game-command signals to the system via a wireless connection (e.g. via connectivity interface means 66). In a co-pending patent by the applicant of the present invention, the buttons and touch-screens of handheld wireless devices such as cell phones and PDAs are employable as a game command interface, meaning that common wireless consumer devices can be used as game controllers. The I/O capabilities of connectivity means 66 (e.g. Internet I/O) provides for the inputting of commands from one or more of such devices. Thus, novel types of video games wherein one's apparel can change according to the input of one or more players-optionally including the input from one's cell phone or PDA—is provided by the present invention.

FIGS. 7A through 7O are cross-sectional illustrations of a variety of types of joints and adjoining means representing a selection group from which one or more methods can be used to join the edges of highly flexible pixelated materials together. Specifically FIG. 7A adjoins pixelated material 12 to create a seam or pleat by an adhesive in a butt-joint. FIG. 7B is similar to 7A using a sonic-weld bead 70 to bond pixelated material 12 in a butt-joint. FIG. 7C adjoins pixelated material 12 by an adhesive in a overlapping-joint. FIG. 7D uses a sonic-weld bead 70 to bond pixelated material 12 in a butt-joint during an ultrasonic welding operation. FIG. 7E adjoins pixelated material 12 by an adhesive in another type of overlapping-joint. FIG. 7F uses a sonic-weld bead 70 to bond pixelated material 12 in a butt-joint during an ultrasonic welding operation. FIG. 7G has an overlapping joint that is held together by one or more staple 74. FIG. 7H has an overlapping joint that is held together by one or more sewn stitch 74. FIG. 7I shows an overlapping joint that can be riveted together. FIG. 7J is an overlapping joint that can be snapped together. FIG. 7K is a tongue-in-groove joint. FIG. 7L a miter joint. FIG. 7M is a joint that can be held together by a hook-and-loop fastener. FIG. 7N is a miter joint that can be sonically-welded. FIG. 7O is variation on a tongue-in-groove joint, and can also be a ball joint, in either case can provide a flexible joint. Several other adjoining means are possible e.g. using one or more zippers, hooks, buttons and the like, however the described adjoining means are meant to be examples of appropriate methods to adjoin edges of highly flexible pixelated materials (to itself, to other segments of like material, or to other apparel components) and are not meant to exhaust all choices or methods available.

Although the present invention has been described in connection with the preferred forms of practicing it, those of ordinary skill in the art will understand that many modifications can be made thereto within the scope of the specification and the claims that follow. Accordingly, it is not intended that the scope of the invention in any way be limited by the above description, but instead be determined entirely by reference to the specification and the claims that follow.

The invention claimed is:

1. A wearable pixelated apparel video-displaying system comprising:

A. at least one apparel segment made entirely or in part of highly flexible pixelated material, said apparel segment(s) having a contiguous video-imaging surface comprised of a multitude of pixels capable of displaying standard video rate, video image content which is contiguous in appearance and which covers up to all of said surface of said segment(s), wherein, at least one of said apparel segment(s) is generally sized and shaped i. to the size and shape of an apparel segment typical of a conventional article of apparel;

ii. to conform to a three-dimensional portion of a body;

B. said segment having at least one side adjoining edge;

C. said apparel having apparel attachment means for adjoining said at least one side adjoining edge(s) to a side adjoining edge of another apparel segment to form an apparel seam which provides for a substantially contiguous display of said video image content across said seam;

D. said pixelated material is equipped with a communications link to communicate with at least one image-playback/image-control portable apparatus;

E. said image-playback/image-control portable apparatus is equipped to playback display imagery content which is shaped in conformance with the size and the shape of said apparel segment(s);

said portable apparatus comprising:

i. at least one control circuit, ii. at least one intelligent controller, iii. at least one electronic power source, iv. at least one input/output interface means for receiving and sending said display imagery content, v. at least one display imagery content playback means, vi. a user interface means for a user to communicate with said portable apparatus and to control the playback of at least one source of display imagery content; and vii. intelligent controller software responsive to user input from said user interface means.

2. The apparel segment attachment means of claim 1 consisting of at least one heat-sealed joint.

3. The apparel segment attachment means of claim 1 consisting of at least one joint having at least one sonic-weld.

4. The apparel segment attachment means of claim 1 consisting of at least one adhesive joint.

5. The apparel segment attachment means of claim 1 consisting of at least one joint having at least one hook-and-loop fastener.

6. The apparel segment attachment means of claim 1 consisting of at least one joint having at least button that is operative in a button hole.

7. The apparel segment attachment means of claim 1 consisting of at least one joint having at least one snap.

8. The apparel segment attachment means of claim 1 consisting of at least one stapled joint.

9. The apparel segment attachment means of claim 1 consisting of at least one riveted joint.

10. The apparel segment attachment means of claim 1 consisting of at least one joint having at least one zipper.

11. The apparel segment attachment means of claim 1 consisting of at least one stapled joint.

12. The apparel segment attachment means of claim 1 consisting of at least one joint having at least one hook.

13. The apparel segment attachment means of claim 1 consisting of at least one joint having at least one tongue-in-groove fastener.

14. The apparel segment attachment means of claim 1 consisting of at least one joint having at least one stitched seam.

15. The apparel segment attachment means of claim 1 consisting of at least one joint having at least one sewed seam.

16. The one input/output interface means of claim 1 further comprising at least one port suitable for optical data communication.

17. The one input/output interface means of claim 1 further comprising at least one port suitable for digital data communication.

18. The source of display imagery content of claim 1 wherein said source is derived from at least one playback device and said device electronically communicates with said apparatus.

19. The content of claim 18 consisting of at least one video game that is responsive to user input from a user interface.

20. The content of claim 18 consisting of at least one advertisement.

21. The content of claim 18 consisting of at least one promotional message.

22. The source of digital media content of claim 1 wherein said source is a live wireless transmission and is wirelessly received by said apparatus.

23. The wearable pixelated apparel of claim 1 comprised of a plurality of flexible lightweight pixelated material segments wherein at least one portion of one of said pixelated material segments is adjoined to at least one portion of a another of said segments by apparel segment electronic coupling means.

24. The user interface means of claim 1 wherein said interface is accessible to a user from at least one surface area of said apparel.

25. The user interface means of claim 1 wherein said interface is substantially housed in a compact enclosure and accessible to a user near at least one surface area of said apparel.

26. The wearable pixelated apparel of claim 1 wherein said apparel is further comprised of a lining material.

27. The standard video rate, video image content of claim 1 wherein said video content is selected from the group consisting of a digital video source; an analog video source; a pre-recorded video source; a live video source; a color video source; a DVD; a CD-ROM; a video game; a video image having the appearance of an entertainment costume; a video image having a fabric appearance; a video representation of a film, an animation, a photograph, a computer-generated image, an advertisement, a promotion, and a cross-promotion.

* * * * *